US005425799A

United States Patent [19]

Koch et al.

[11] Patent Number: 5,425,799

[45] Date of Patent: Jun. 20, 1995

[54] PROCESS FOR ROASTING REFRACTORY GOLD ORES

[75] Inventors: Walter Koch, Mülheim; Bodo Peinemann, Frankfurt am Main, both of Germany

[73] Assignee: Metallgesellschaft Aktiengesellschaft, Frankfurt am Main, Germany

[21] Appl. No.: 237,358

[22] Filed: May 2, 1994

[30] Foreign Application Priority Data

Apr. 30, 1993 [DE] Germany ..... 43 14 231.1

[51] Int. Cl.[6] ..... C22B 1/10

[52] U.S. Cl. ..... 75/423; 423/47; 423/DIG. 16

[58] Field of Search ..... 75/423; 423/47, DIG. 16

[56] References Cited

U.S. PATENT DOCUMENTS 5,123,956 6/1992 Fernandez et al. ..... 75/423

FOREIGN PATENT DOCUMENTS 508542 10/1992 European Pat. Off. .

*Primary Examiner*—Melvyn J. Andrews

[57] ABSTRACT

Refractory gold ores are roasted at temperatures from 500° to 650° C. in an oxidizing atmosphere in a fluidized bed, which is supplied with a carbonaceous additional fuel. To effect a substantially complete combustion of the additional fuel to form $CO_2$ and $H_2O$, methanol is added as a carbonaceous fuel.

8 Claims, 1 Drawing Sheet

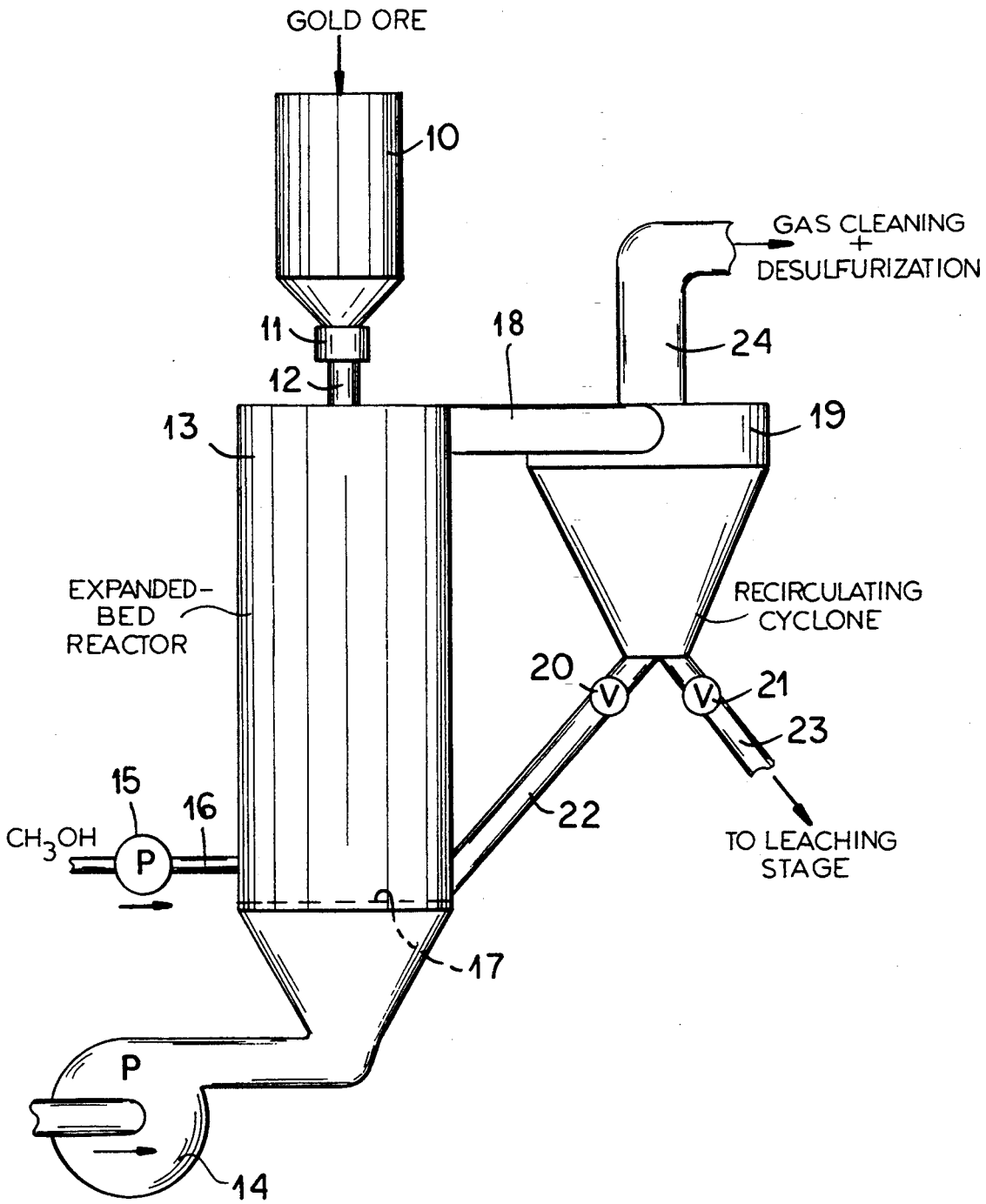
GOLD ORE
10
GAS CLEANING
+
DESULFURIZATION
11
18
24
12
13
19
EXPANDED-
BED
REACTOR
RECIRCULATING
CYCLONE
20
V
V
21
23
15
16
22
$CH_3OH$
P
TO LEACHING
STAGE
17
P
14

PROCESS FOR ROASTING REFRACTORY GOLD ORES

FIELD OF THE INVENTION

The present invention relates to a process for roasting refractory gold ores in an oxidizing atmosphere in a fluidized bed with the addition of carbonaceous fuels.

BACKGROUND OF THE INVENTION

Refractory gold ores or concentrates are ores which cannot directly be leached with NaCN and contain gold-bearing compounds consisting of arsenopyrites or pyrites comprising more or less organic carbon. They have a relatively low gold content.

Before such ores are leached with cyanide, the sulfur and carbon contents must be oxidized as completely as possible. That oxidation is usually effected by a roasting with oxygen-containing gases. In numerous refractory gold ores the existing contents of arsenopyrite, pyrite and organic compound are not sufficient for the generation of the required reaction heat so that fuel must be added. A large number of refractory gold ores must be roasted at a relatively low temperature to ensure that the subsequent leaching will result in a high yield of gold.

It is known from EP-A-508,542 to roast gold ores at temperatures from 475° to 660° C. and particularly from 500° to 575° C. Coal, butane or propane have been mentioned as fuels to be added. The flash point should be equal to or lower than that of propane. But only an unsatisfactory proportion of propane and butane is combusted to form $CO_2$ and $H_2O$. Coal, if it is used, must be disintegrated to a size which is sufficiently small for use in the fluidized bed.

OBJECTS OF THE INVENTION

The principal object of the present invention is to provide an improved process for the roasting of gold ores whereby drawbacks obtained with the addition of earlier carbonaceous fuels can be obviated.

It is also an object of the invention to provide an improved process for the purposes described which will overcome drawbacks of the earlier processes.

It is an object of the present invention to use a fuel which is substantially completely combusted to form $CO_2$ and $H_2O$ and the use of which involves only low cost.

SUMMARY OF THE INVENTION

That object is accomplished in accordance with the invention in the process described first hereinbefore in that methanol ($CH_3OH$) is added as a carbonaceous fuel to the fluidized bed and roasting is effected at temperatures from 500° to 650° C. The rate at which methanol is added will depend on the processing conditions in each case. Roasting may be effected in an orthodox fluidized bed or a circulating fluidized bed.

The use of methanol as a carbonaceous fuel surprisingly results in the fluidized bed in a more complete combustion to form $CO_2$ and $H_2O$. It is believed that the refractory gold ores have a catalytic activity promoting the combustion of methanol. Methanol can be supplied to the fluidized bed in a simple manner.

According to the invention, roasting can be effected at temperatures from 540° to 580° C. The material which has been roasted at such temperatures has particularly good properties for leaching.

According to a preferred feature of the invention, methanol is added as a liquid to the fluidized bed. The addition as a liquid results in higher conversions to $CO_2$ and $H_2O$.

Advantageously, roasting is effected in a circulating fluidized bed. The circulating fluidized bed system consists of the fluidized bed reactor, the recycle cyclone and the recycle line. From the "orthodox" fluidized bed, in which a dense phase is separated by a distinct density step from the overlying gas space, that fluidized bed concept differs by states of distribution without a defined boundary layer. There is no density step between a dense phase and the overlying dust space but the solids concentration in the reactor decreases continuously from bottom to top. A gas-solids suspension is discharged from the top part of the reactor. In the definition of the operating conditions by the Froude and Archimedes numbers the following ranges are obtained:

$$0.1 \leqq 3/4 \times Fr^2 \times \frac{\rho_g}{\rho_k - \rho_g} \leqq 10$$

and $$0.01 \leqq Ar \leqq 100$$

wherein $$Ar = \frac{d_k^3 \times g(\rho_k - \rho_g)}{\rho_g \times \nu^2}$$

and $$Fr^2 = \frac{u^2}{g \times d_k}$$

u=relative gas velocity in m/sec.
Ar=Archimedes number
Fr=Froude number
$\rho_g$=density of gas in kg/m$^3$
$\rho_k$=density of solid particle in kg/m$^3$
$d_k$=diameter of spherical particles in m
$\nu$=kinematic viscosity in m$^2$/sec.
g=constant of gravitation in m/sec$^2$ The suspension gas which is discharged from the fluidized bed reactor is supplied to the recycle cyclone of the circulating fluidized bed. Substantially all solids are removed in that cyclone and are so recycled to the fluidized bed reactor that the amount of solids which are circulated per hour in the circulating fluidized bed system is at least four times the weight of the solids contained in the fluidized bed reactor.

In a circulating fluidized bed system, particularly good results are produced as regards a high conversion of the methanol to form $CO_2$ and $H_2O$ and a good leachability of the ore.

According to a preferred feature the particle size of the gold ore is below 1 mm. Good results are produced with the particle size.

According to a preferred feature, 60 to 80% of the gold ore has a particle size below 75 micrometers. Particularly good results are produced with that particle size.

BRIEF DESCRIPTION OF THE DRAWING

The above and other objects, features, and advantages will become more readily apparent from the following description, reference being made to the accompanying drawing, the sole FIGURE of which is a diagram illustrating an apparatus for carrying out the process of the invention.

SPECIFIC DESCRIPTION

In the drawing, we have shown a bin 10 for gold ore comminuted to a particle size of less than 1 mm and preferably with 60 to 80% of a particle size below 75 μm, having a gate 11 for metering the gold ore through a downcomer, 12 into an expanded bed reactor 13. The expanded bed reactor receives the oxygen/nitrogen mixture for roasting the ore from a blower 14 through a great or perforated plate at the bottom of the expanded bed reactor. In the reactor, the ore is roasted at a temperature preferably between 540° C. and 580° C.

The temperature in the reactor is maintained by adding, as a carbonaceous fuel, liquid methanol ($CH_3OH$) which is pumped into the reactor via a pump 15 at an inlet 16 close to the grate 17.

As is customary with an expanded bed, the bed particles entrained by the effluent gases are conducted at 18 to a cyclone 19 or other gas/solid separator. From the cyclone, as controlled by gates 20 and 21, a portion of the solids are recirculated to the fluidized bed via the line 22 while another portion may be fed at 23 to a leaching stage in which gold is leached from the roasted ore. The gas, which has been separated from the solids, is discharged at 24 to a gas clean and desulfurization plant.

SPECIFIC EXAMPLE

A refractory gold ore is used which contains 8 g gold per 1000 kg and 2.5% sulfide sulfur, which is present as pyrite. The particle size is $d_{50}=30$ micrometers and 100%<200 micrometers.

The pilot plant is a circulating fluidized bed system consisting mainly of the fluidized bed reactor, a recycle cyclone, which is directly connected to the gas outlet at the top of the reactor, and a recycle line. The solids which have been separated in the cyclone are recycled to the reactor in the recycle line.

Ore at a rate of 40 kg/h are charged to the fluidized bed reactor by a downcomer.

The wind box of the fluidized bed reactor is supplied with an entraining gas at a rate of 35 $sm^3/h$ ($sm^3$=standard cubic meter=$m^3$ STP), at a temperature of 500° C. and under a pressure of 1.1 bars. The entraining gas consists of a mixture of $O_2$ and $N_2$ and contains 13% by volume $O_2$. The entraining gas flows at a velocity of 60 m/sec. through the openings of the perforated bottom. The temperature in the reactor is 560° C.

Methanol at a rate of 75 kg/h is supplied as an additional fuel to the reactor above the perforated bottom. The gas from roasting contains 2% $SO_2$,/1,25% $CO_2$, 0.25% CO, and 8% $O_2$. The roasted material contains <0.1% sulfide sulfur. The further processing results in a gold yield of 90%.

We claim:

1. A process for roasting a refractory gold ore, comprising the steps of:

(a) fluidizing comminuted refractory gold ore in a fluidized bed;

(b) reacting the fluidized gold ore with an oxygen containing gas in said fluidized bed at a temperature of 500° to 650° C. to roast said gold ore; and (c) maintaining said temperature at least in part by adding methanol as a carbonaceous fuel to said bed and combusting the methanol therein.

2. The process defined in claim 1 wherein said roasting of the gold ore in the fluidized bed is effected at a temperature maintained at 540° to 580° C.

3. The process defined in claim 1 wherein the methanol is added as a liquid to said fluidized bed.

4. The process defined in claim 1, further comprising the step of operating said fluidized bed as a recirculating fluidized bed with recycling of solids.

5. The process defined in claim 4 wherein said gold ore has a particle size below 1 mm.

6. The process defined in claim 5 wherein 60% to 80% of the gold ore has a particle size below 75 μm.

7. The process defined in claim 6 wherein said roasting of the gold ore in the fluidized bed is effected at a temperature maintained at 540° to 580° C.

8. The process defined in claim 7 wherein the methanol is added as a liquid to said fluidized bed.

* * * * *